US005402899A

United States Patent [19]

Ammeson

[11] Patent Number: 5,402,899

[45] Date of Patent: Apr. 4, 1995

[54] HOLDER FOR CONDIMENT BOTTLE

[76] Inventor: Lynn Ammeson, 6166 N. Sheridan, 18J, Chicago, Ill. 60660

[21] Appl. No.: 65,838

[22] Filed: May 21, 1993

[51] Int. Cl.[6] ..... B30B 15/00

[52] U.S. Cl. ..... 215/100 R; D7/619; 222/179.5; 248/107; 248/117.2; 248/153

[58] Field of Search ..... 298/153, 311.2, 314, 298/311.3, 302, 107, 117.1, 117.2; 206/139; D7/619, 704, 701; 215/100 R, 100 A, 237, 227, 244, 245; 222/173, 179.5

[56] References Cited

U.S. PATENT DOCUMENTS

| | | | |
|---|---|---|---|
| 2,280,940 | 4/1942 | Wightman | 248/107 |
| 2,459,514 | 1/1949 | Flickinger | 248/302 X |
| 2,481,773 | 9/1949 | Nelson | 248/107 |
| 2,669,407 | 2/1954 | Roselle | 248/107 |
| 2,703,689 | 3/1955 | Williams | 248/153 X |
| 2,873,850 | 2/1959 | Ortegren | 248/311.2 X |
| 2,912,200 | 11/1959 | Reinhorn | 248/107 X |
| 3,173,641 | 3/1965 | Dorrance | 248/153 |

*Primary Examiner*—Ramon O. Ramirez
*Attorney, Agent, or Firm*—Juettner Pyle Lloyd & Piontek

[57] ABSTRACT

A storage holder for a condiment bottle, such as a bottle of catsup having a cap, includes a base, and an upright support for the bottle, which supports the bottle on an angle relative to horizontal, with the cap facing downwardly. Upon removal of the bottle from the holder, and upon removal of the cap, initial pouring of the condiment from the bottle is greatly facilitated.

5 Claims, 1 Drawing Sheet

HOLDER FOR CONDIMENT BOTTLE

BACKGROUND OF THE INVENTION

This invention relates to holders for condiment bottles and more particularly to a holder which will facilitate pouring of viscous condiments from bottles.

The difficulty to pour catsup or other viscous condiments from glass bottles is well known. The bottles have a tapered neck and a circular opening covered by a cap. The bottle is supported on its base in an upright position. In most cases, it is difficult to start a flow of catsup from the bottle without slapping the base or sides, or inserting an object into the opening. This is particularly the case in many restaurants where the bottle is maintained in a completely filled condition.

SUMMARY OF THE INVENTION

In accordance with the present invention, a support in the form of a stand is provided for holding a condiment bottle at an angle, with the base of the bottle being supported above the capped end thereof. The stand may comprise a base portion that is supported on a horizontal surface such as a table, and a bottle embracing portion connected to the base for holding the bottle in the aforesaid angle, with the capped end being spaced from the horizontal surface. The bottle embracing portion preferably embraces the neck of the bottle to facilitate removal of the bottle from the stand.

The bottle is placed in the stand when not in use. The inclined support causes the surface area of the condiment to be enlarged and the air pressure to equalize, thereby greatly facilitating the initial pouring of the condiment from the bottle.

THE DRAWING

DESCRIPTION OF THE PREFERRED EMBODIMENT

Figure 1:
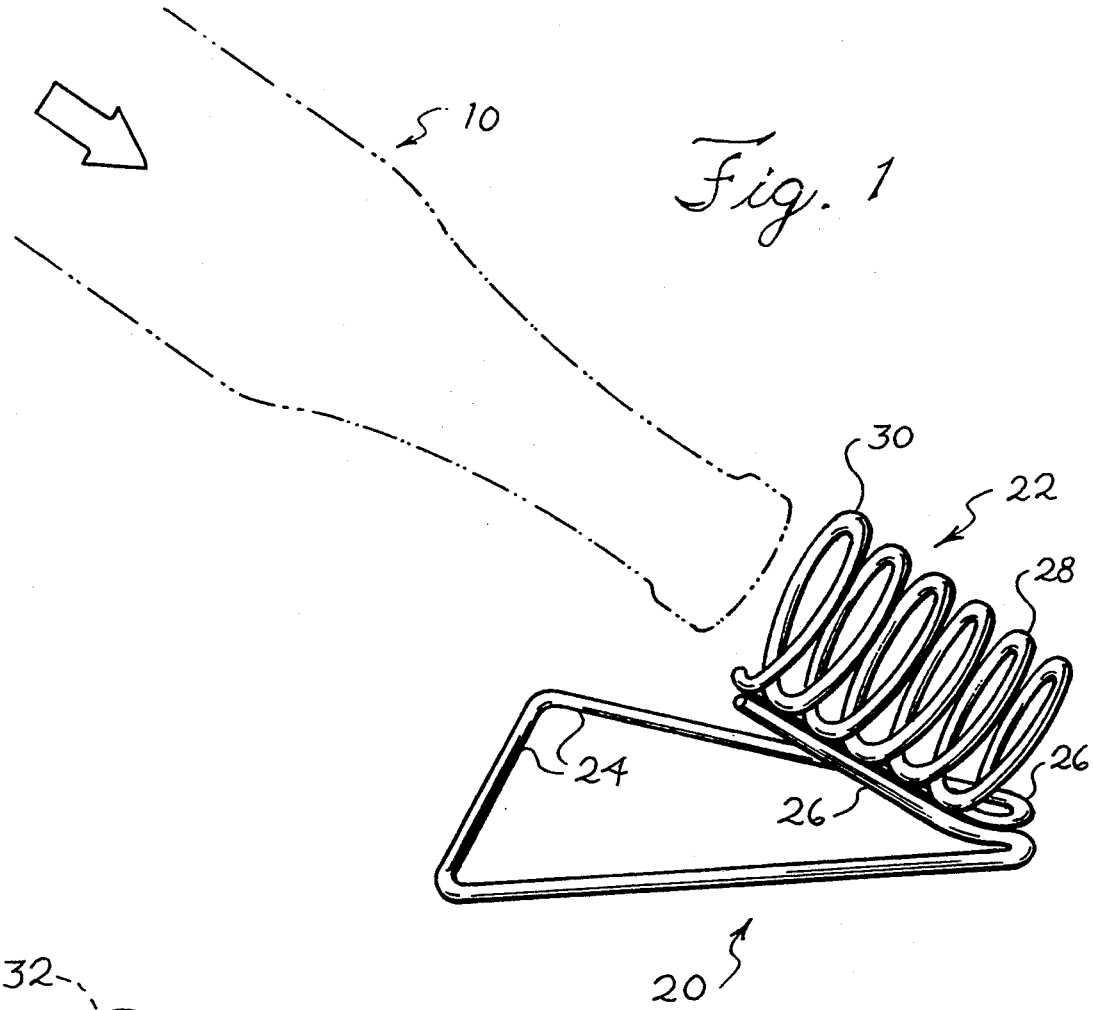
FIG. 1 is a perspective view of the holder of the present invention, with a condiment bottle shown in outline being inserted into the holder.
Figure 2:
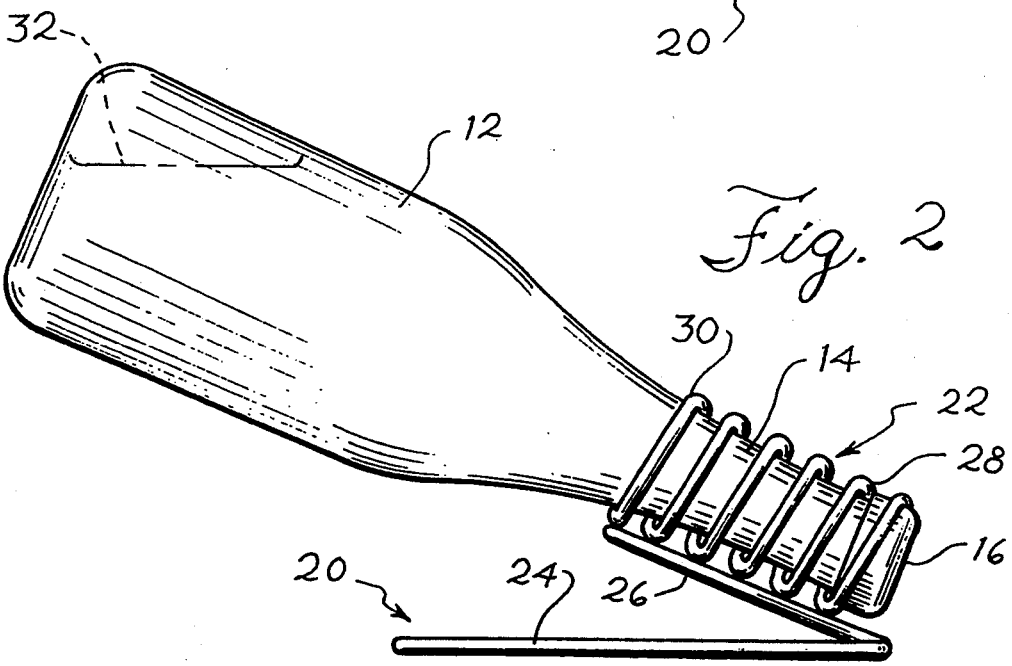
FIG. 2 is a side view of the holder shown in FIG. 1, with the condiment bottle being shown in a fully inserted position.

The figures illustrate the condiment holder or support of the present invention, in which a container, such as a bottle 10 having a cylindrical body 12 and a smaller diameter neck 14 tapering away from the body, with the outlet opening of the bottle being closed by a removable cap 16.

The holder of the present invention, in the form of a support or a stand, is designed to hold a container at an angle with the capped opening thereof facing downwardly and spaced from a horizontal support surface, such as the top of a table. The angle of the longitudinal centerline of the bottle relative to horizontal is in the order of 20 to 70 degrees, with a shallow angle being most preferable.

As shown, the support comprises a base 20 adapted to support on a horizontal surface, and a container support portion 22 extending upwardly at an angle over the base. In the particular embodiment shown, the base 20 may comprise a continuous length of wire having three legs 24 arranged in an elongated triangular fashion, with the two end portions 26 of the wire being bent upwardly and at an angle over the base.

The container support portion 22 preferably comprises a continuous helix 28 or spaced loops or rings of wire secured to the end portions 26 of the base, such as by welding. The helix 28 may be slightly spiral in nature, with the inner diameter of the helix being somewhat greater than the diameter of the bottle neck 14.

The capped bottle is inserted (FIG. 1) into the helix 28 until the upper spiral ring 30 of the helix comes into contact with the outwardly tapering neck of the bottle. In a fully inserted position, the main body 12 of the bottle is fully exposed, and the bottle may be easily removed. Even though the body of the container or bottle is not directly supported, the bottle in an inserted position is very stable, since the weight of the bottle is directed downwardly at an angle, with the support portion 22 and bottle 10 extending back over the base 20. Also, the length of the helix 28 is preferably coextensive with at least a majority of the length of the bottle neck 14 to provide support for various types of bottles. The bottle will still be properly supported if only the lower area at the base of the neck and an upper area near the cap are in contact with the helix or loops.

Obviously, many variations in the details of construction are possible. For example, the central rings or loops of the helix 28 could be deleted and be replaced by a pair of rings, as long as at least a pair of spaced support elements are provided for encircling the approximate spaced areas of the bottle neck.

The stand may be made of any suitable material, such as stainless steel wire, or wire coated with a plastic material. In the embodiment shown, the wire is easily bent into the desired shapes by use of conventional equipment.

It may be seen that since the bottle is normally stored for long periods on an angle, the air normally located between the cap and the catsup in the neck will move t the raised bottom of the bottle, as shown at 32. Also, the solids in the neck of the bottle will be disposed on an angle, rather than a small circular disk, the latter being the case when the bottle is stored in its normal upright position.

It may be seen that the bottle is stored in the holder with the cap applied. Upon removal of the bottle from the holder, the bottle cap is removed, and the contents are easily dispensed.

I claim:

1. The combination of a condiment bottle and a holder to facilitate dispensing of the condiment from the bottle, said combination comprising an elongate bottle containing viscous condiment and having a capped and sealed end, said holder comprising a support base, and bottle support means secured to said base for loosely supporting said condiment bottle on an angle with the capped and sealed end facing downwardly, said bottle being freely upwardly removable from said bottle support means to enable opening of said capped and sealed end and dispensing of said condiment.

2. The combination of claim 1 wherein said bottle support means comprises a support having an upper open end, and said bottle comprises a body, a neck of reduced diameter relative to said body, and a shoulder between said body and said neck, and wherein said bottle is received in said support with said shoulder in abutment with said upper open end.

3. The combination of claim 2 wherein said support base comprises a triangular loop of wire, said loop having a pair of bent up legs secured to said support.

4. The combination of claim 2 wherein said support comprises a helix.

5. A method for facilitating the dispensing of a viscous condiment from a container, said method comprising the steps of removably supporting a container of viscous condiment having a closed cap at one end in a support along an angle of from about 20 to about 70 degrees relative to horizontal, with the closed cap facing downwardly, and for a sufficient period of time to enable the viscous liquid to flow toward a horizontal level, then removing the container from the support, removing the cap, and dispensing the viscous condiment.

* * * * *